US009132435B2

(12) United States Patent
Mackel

(10) Patent No.: US 9,132,435 B2
(45) Date of Patent: Sep. 15, 2015

(54) SEPARATOR WITH RIB BODY ARRANGED IN ADMISSION CHAMBER

(75) Inventor: Wilfried Mackel, Lippetal-Herzfeld (DE)

(73) Assignee: GEA Mechanical Equipment GmbH, Oelde (DE)

( * ) Notice: Subject to any disclaimer, the term of this patent is extended or adjusted under 35 U.S.C. 154(b) by 782 days.

(21) Appl. No.: 13/382,537

(22) PCT Filed: Jul. 9, 2010

(86) PCT No.: PCT/EP2010/059912

§ 371 (c)(1),
(2), (4) Date: Jan. 6, 2012

(87) PCT Pub. No.: WO2011/004014

PCT Pub. Date: Jan. 13, 2011

(65) Prior Publication Data

US 2012/0108413 A1 May 3, 2012

(30) Foreign Application Priority Data

Jul. 10, 2009 (DE) ..... 10 2009 032 617

(51) Int. Cl.
*B04B 11/06* (2006.01)
*B04B 1/08* (2006.01)

(52) U.S. Cl.
CPC .. *B04B 1/08* (2013.01); *B04B 11/06* (2013.01)

(58) Field of Classification Search
CPC ..... B04B 11/06; B04B 1/08
USPC ..... 494/64, 67–73
See application file for complete search history.

(56) References Cited

U.S. PATENT DOCUMENTS

| | | | | | |
|---|---|---|---|---|---|
| 2,243,697 | A * | 5/1941 | Forsberg | 494/15 |
| 4,430,071 | A * | 2/1984 | Willus et al. | 494/38 |
| 4,482,344 | A * | 11/1984 | Zettier | 494/70 |
| 4,701,158 | A * | 10/1987 | Inge et al. | 494/74 |
| 4,721,505 | A * | 1/1988 | Inge et al. | 494/74 |
| 4,961,723 | A * | 10/1990 | Bruning et al. | 494/56 |
| 5,045,049 | A * | 9/1991 | Lantz | 494/70 |
| 5,362,292 | A * | 11/1994 | Borgstrom et al. | 494/74 |
| 6,102,843 | A * | 8/2000 | Kelley et al. | 494/29 |
| 6,533,713 | B1 * | 3/2003 | Borgstrom et al. | 494/66 |
| 8,585,566 | B2 * | 11/2013 | Mackel et al. | 494/70 |
| 2011/0215044 | A1 * | 9/2011 | MacKel et al. | 210/403 |
| 2012/0108413 | A1 * | 5/2012 | Mackel | 494/65 |
| 2015/0024921 | A1 * | 1/2015 | Borgstrom et al. | |

FOREIGN PATENT DOCUMENTS

| | | | |
|---|---|---|---|
| DE | 36 27 826 | | 10/1987 |
| DE | 10 2004 038 613 | | 3/2005 |
| DE | 102006047478 | A1 * | 4/2007 |
| EP | 1 508 377 | | 2/2005 |
| EP | 2628544 | A1 * | 8/2013 |

* cited by examiner

*Primary Examiner* — Charles Cooley
(74) *Attorney, Agent, or Firm* — Crowell & Moring LLP

(57) ABSTRACT

A separator in which a product such as milk is to be processed, the separator includes: a centrifugal drum; an admission tube; a distributor including an admission chamber located downstream of the admission tube and distribution channels leading into a centrifugal chamber of the centrifugal drum. A rib body is located in the admission chamber and the rib body provides an outlet to the distributor channels. The rib body includes a plurality of ribs and a base section connecting the plurality of ribs along a periphery of the base section.

7 Claims, 3 Drawing Sheets

SEPARATOR WITH RIB BODY ARRANGED IN ADMISSION CHAMBER

This application is a national stage of International Application PCT/EP2010/059912, filed Jul. 9, 2010, and claims benefit of and priority to German Patent Application No. 10 2009 032 617.0, filed Jul. 10, 2009, the content of which Application is incorporated by reference herein.

BACKGROUND AND SUMMARY

The present disclosure relates to a separator in which a product such as milk is to be processed. The separator has a vertical axis of rotation and includes: a centrifugal drum; an admission tube; a distributor including an admission chamber located downstream of the admission tube and distribution channels leading into a centrifugal chamber of the centrifugal drum. A rib body is located in the admission chamber and the rib body provides an outlet to the distributor channels.

Such a separator is known from DE 10 2004 038 613 A1. As described in this document, when separators are used to sterilize milk, short-term deteriorations in the sterilization efficiency possibly occur as a result of pressure rises in the admission system caused, for example, by partial emptying, switching tanks or by an increased air content in the product. Another problem is the transport, shaft run, of bacteria to the skimming disk.

In order to solve this problem, it is proposed in DE 10 2004 038 613 A1 that connecting bores are provided to a ring-shaped cavity which is formed above the free end of the admission tube in the distributor, that the connecting bores extend between a preferably conical feed region and the ring-shaped cavity and that respectively one rib is assigned to the outlet openings from the feed region into the feed bores of the distributor and the connecting bores to the ring-shaped cavity. By this means a particularly uniform acceptance and acceleration and a particularly uniform ventilation of the product is achieved, relatively constant ventilation values can be achieved even when the air content in the product is elevated.

This solution has proved successful but can be further optimized again particularly in the constructive aspect and preferably with regard to its efficiency.

The solution is the subject of the present disclosure discussed below.

The present disclosure relates to a separator in which a product such as milk is to be processed. The separator includes: a centrifugal drum; an admission tube; a distributor including an admission chamber located downstream of the admission tube and distribution channels leading into a centrifugal chamber of the centrifugal drum. A rib body is located in the admission chamber and the rib body provides an outlet to the distributor channels. The rib body includes a plurality of ribs and a base section connecting the plurality of ribs along a periphery of the base section.

The rib body is easy to mount. In addition, the admission pressure can be reduced and the admission capacity increased. This results in a gentle product supply in the distributor. In addition, the risk of deposits forming in the admission region is reduced.

According to the present disclosure, one or several of the rotational axes are aligned, which means a strong acceleration of the material to be centrifuged in the circumferential direction. However, it is within the scope of the present disclosure to adjust this relative to the respective radials, for example between 1° and 80°. The ribs can be configured to be straight but also curved. A shovel-like design with curvatures in all spatial directions is within the scope of the present disclosure as long as an acceleration effect is given in the circumferential direction.

Embodiments according to the present disclosure are further discussed herein including the claims.

Other aspects of the present disclosure will become apparent from the following descriptions when considered in conjunction with the accompanying drawings.

DETAILED DESCRIPTION

Figure 1:
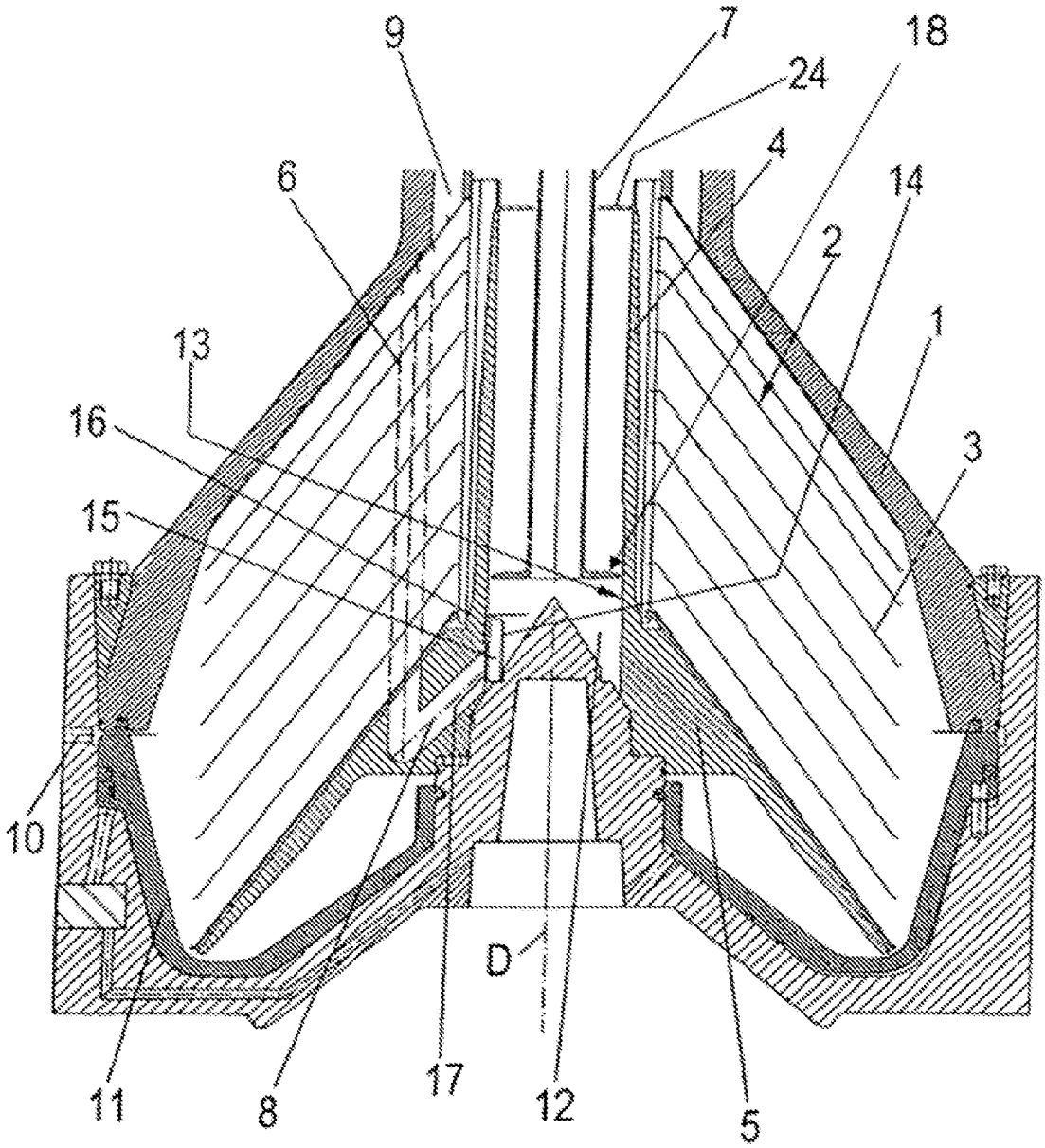
FIG. 1 shows a sectional view of a centrifugal drum of a separator according to the present disclosure.

FIG. 1 shows a view of a partial region of a centrifugal drum 1, which is rotatable about a rotational axis D, of a continuously operable separator. The drum 1 includes a plate package 2 that includes a plurality of plates 3. The drum 1 is disposed concentrically to the machine axis or rotational axis D. The centrifugal drum shown in FIG. 1 is configured to be internally double-conical.

The plates 3 have a conical shape, are stacked axially one above the other, and are spaced apart from one another by spacers, for example, tabs (not shown).

The plate package 2 is held on a distributor shaft 4 of a distributor 5 which is provided on its external circumference with radially outwardly projecting webs (not shown) which on the internal circumference of the plates 3 engage therein. The plate package 2 has rising channels 6 which include holes in the plates 3 located directly above one another and extending over the entire height of the plate package 2.

An admission tube 7 located concentrically to the machine axis D allows the admission of material to be centrifuged, for example, from above into the centrifugal drum 1 and there through the distributor shaft 4 and distributor channels 8 formed below the plate package 2 in the distributor 5 into the plate package 2, for example, in the area of the rising channel 6 or at another point.

The actual clarification of the product to be processed from solids, for example, for sterilization and/or a separation of the product into different liquid phases which are then led off from the centrifugal drum 1 through one or more discharge lines 9, possibly to different diameters, for example, through skimming disks (not shown) and solid removal openings 10, then takes place continuously in the centrifugal drum 1. A piston slider 11 is located upstream of the solid removal openings 10, which slider 11 is movable vertically and by which slider 11 the solid removal openings 10 can be opened and closed.

Of particular interest is the structure of the admission region from the admission tube 7, which is stationary in operation, into the distributor 5, which rotates during operation, for example, from the system which does not rotate during operation into the system which rotates during operation.

A product supplied through the admission tube 7 initially enters from the admission tube 7 into an admission chamber 12 at the center of the distributor shaft 4, where the free lower outlet of the admission tube 7 extends as far as below the upper edge of the admission chamber 12.

The distributor channels 8 begin in the peripheral wall 13 of the admission tube 7.

The admission chamber 12 is configured, as shown in FIG. 1, in such a manner that a rib body 14, including one or more ribs 15, can be inserted therein. The rib body 14 is connected in a torque-proof manner to the centrifugal drum 1, or, in accordance with the present disclosure, may be connected to the distributor 5.

Figure 4:
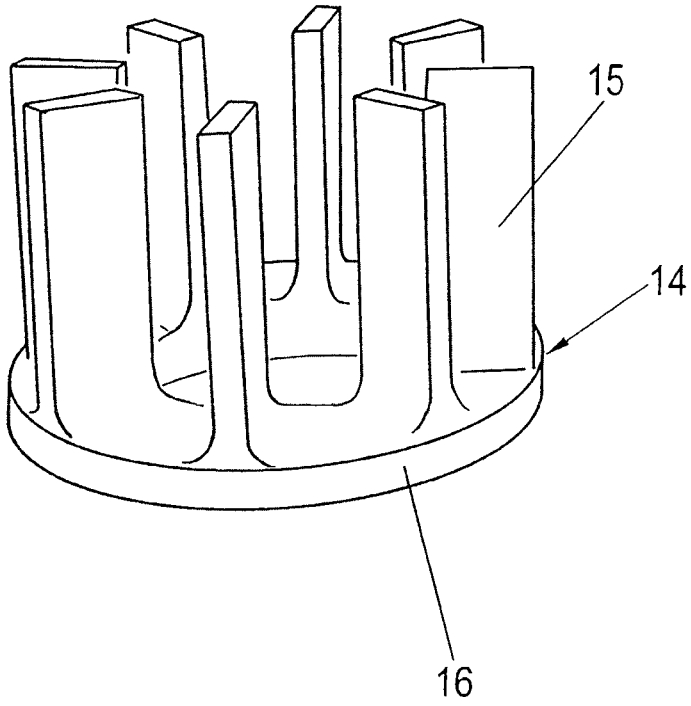
FIGS. 3 and 4 each show perspective views of rib bodies, according to the present disclosure.
Figure 3:
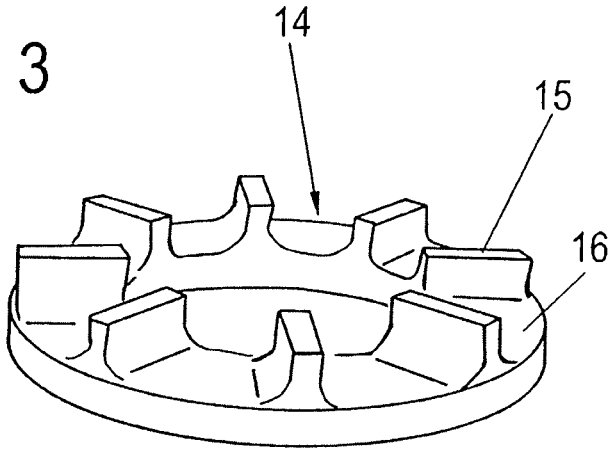

As an example, two different rib bodes 14 are shown in FIGS. 3 and 4.

The rib bodies 14 each include a base section 16. This base section 16 is, for example, configured as a circumferentially closed ring section.

Figure 2:
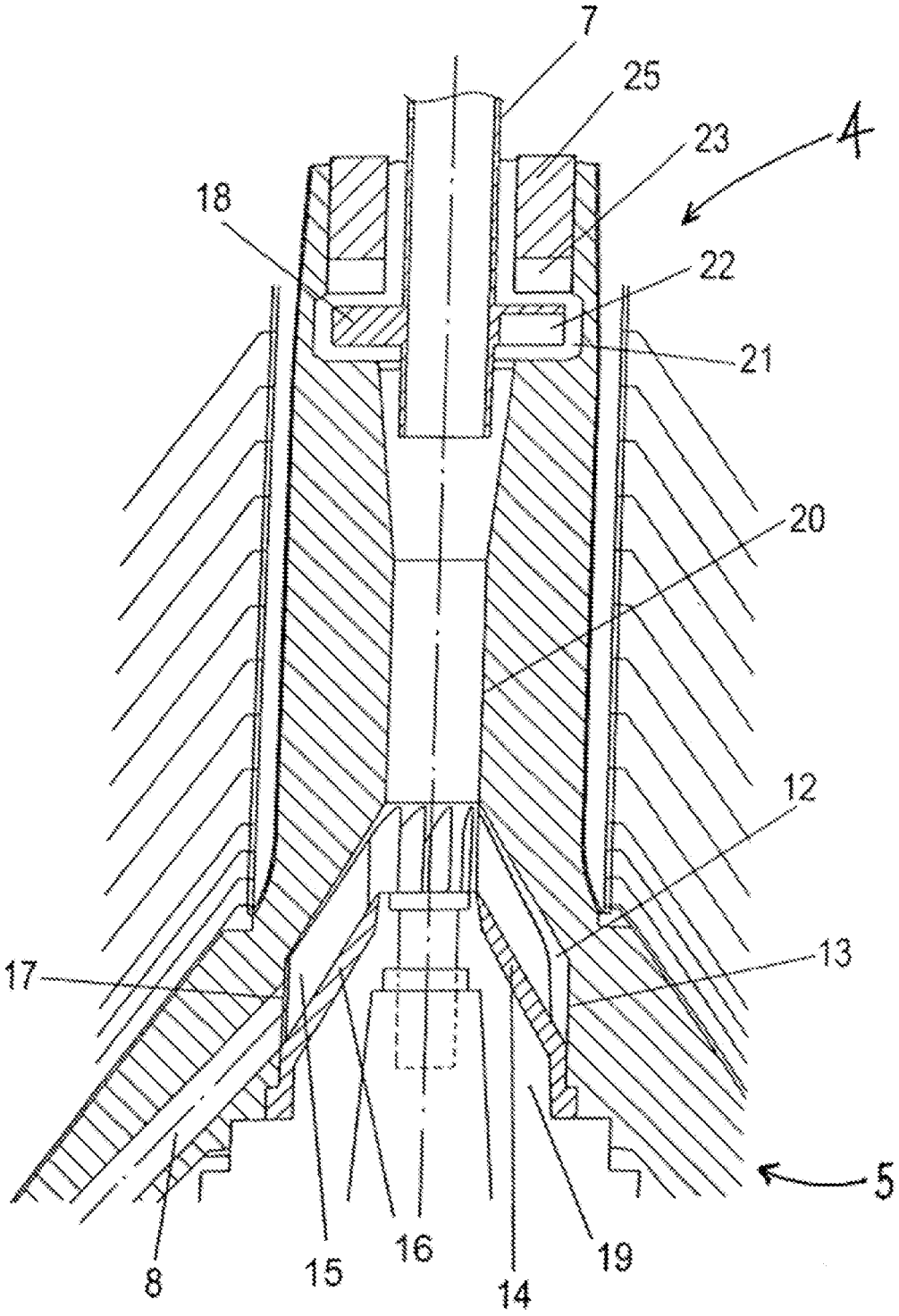
FIG. 2 shows a sectional view through a partial region of an embodiment of a centrifugal drum, according to the present disclosure.

As shown in FIGS. 3 and 4, the annular base sections 16 are configured to be flat so that in the built-in state they extend perpendicularly to the rotational axis D. In FIG. 1, the base section 16 extends vertically. In FIG. 2, on the other hand, the base section 16 is configured to be conical.

The base sections 16 are connected to the rotating system, for example, to the distributor 5 in a torque-proof manner.

The shape of the base section 16, for example, corresponds to the shaping of the distributor 5 in a corresponding abutment or contact area.

From the annular base section 16, the ribs 15 project vertically upright and in the built-in state, they are also aligned vertically upright.

The base sections 16 shown in the embodiments of FIGS. 3 and 4 are, for example, aligned vertically downwards so that the ribs 15 project vertically upwards into the admission chamber 12.

The ribs 15 of the embodiments, according to the present disclosure, are formed in one piece with the base section 16 and project vertically from the one axial side thereof. The ribs 15 are configured to be distributed circumferentially on the base body 16. The radial length of the ribs 15, for example, corresponds at least to the vertical height of the inlet openings 17 into the distributor channels 8.

According to an embodiment of the present disclosure, the ribs 15 are aligned radially to the rotational axis D (see FIG. 3, FIG. 4). However, —the ribs 15 may be aligned at an angle to the radial direction (see FIG. 2).

The rib body 14 is inserted or built into the annular chamber 12.

A bore-like inlet opening 17, from the admission chamber 12 into the admission boreholes or channels 8, is formed in the direction of rotation, for example, clockwise, directly behind each of the ribs 15 and radially outside the ribs 15. The ribs 15 are located radially on the inside with respect to the inlet openings 17.

It is advantageous, according to the present disclosure, that the rib body 14 as a whole or as a single element may be set extremely simply in the admission chamber 12 when assembling the centrifugal drum 1, where it is fixed in a torque-proof manner on the distributor 5, which can be accomplished, for example, by fastening with, for example, screws, in a bayonet-like manner, welding or the like.

As a result of the vertical and radial alignment or inclined alignment of the ribs 15 in an angular range between ±50° to a radial running from a center of base body 16 radially outwards, the product emerging from the admission tube 7 is accelerated to the rotational speed of the centrifugal drum 1 and fed in a gentle manner into the admission channels 8 of the distributor 5.

In addition, the admission chamber 12 is configured in such a manner that, during operation, a pressure increase is established in the admission chamber 12, as compared with an embodiment of the present disclosure without the rib body 14.

In the embodiment of FIG. 1, this is achieved by the admission tube 7 having a disk section 18, for example, a hydrodisk, which may be formed at the vertically lower end of the admission tube 7 where it extends from the admission tube 7 perpendicular to the rotational axis D or at right angles to the axial direction of the admission tube 7 outwards as far as in front of the inner peripheral wall of the distributor 5. A remaining gap may be smaller than 10 mm, or, may be smaller than 7 mm. A radially inward projecting attachment 24 on the upper end of the distributor 5 forms an additional closure radially upwards during operation.

In tests it has been shown that the admission pressure can be reduced, by installing the rib body 14, for example, by 0.5 bar at 80 000 l/h admission capacity. The admission capacity can be increased accordingly.

A structure similar to FIG. 1 is shown in FIG. 2, but the ribs 15 shown in FIG. 2 are not aligned radially but inclined obliquely to the radial so that the ribs 15 enclose an angle with the respective radials.

In addition, in FIG. 2 the base section 16 is conically shaped so that it can be placed on a corresponding conical section 19 of the distributor 5, where the ribs 15 extending vertically upwards from the base section 16 and also follow the conical shape of the base section 16.

The admission chamber 12, according to FIG. 2, is also formed conically, at least in the region in which the ribs 15 are formed.

An axial tube section 20 of the distributor 5 extends above the admission chamber 12. In an embodiment according to the present disclosure, tube section 20 is configured to be slightly conical in its upper vertical region in which the admission tube 7 ends and cylindrical in the adjoining lower region where the diameter in this region may correspond to the diameter of the admission tube 7. In the conical region, the inside diameter may not be more than 10 mm, or not more than 7 mm, larger than the outside diameter of the admission tube 7.

The admission tube 7 in turn extends axially into an intake region of the distributor 5.

The admission tube 7 is surrounded by a disk section 18. This disk section 18 may however, not be formed at the free axial end of the admission tube 7 but at a little distance from its axial end.

The disk section 18 extends radially into an annular chamber 21 which extends vertically above and below the disk section 18 and radially inwards over the outer circumference of the disk section 18. The annular chamber 21 vertically adjoins the tube section 20 of the distributor 5. In a further embodiment according to the present disclosure, ribs 23, which may be aligned partially radially, are formed on the upper edge of the annular chamber 21 on a ring 25 connected to the distributor 5 in a torque-proof manner during operation or connected to another machine part which rotates during operation. The ribs 23 entrain the material to be centrifuged in the annular chamber 21 in the circumferential direction during operation and thereby contribute to the fact that a radial liquid level can form in the annular chamber 21.

In turn, vertical ribs 22 may be formed on the disk section 18.

During operation, a liquid ring is formed outside in the annular chamber 18 which closes the admission region or tube 7 vertically towards the bottom.

In combination with rib body 14 in the admission region or tube 7, the admission pressure can in turn be reduced and the admission capacity increased.

In addition, the risk of contamination of the admission region or tube 7 of the centrifugal drum 1 is particularly low.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A separator in which a product is to be processed, the separator comprising:

a centrifugal drum;

an admission tube:

a distributor including an admission chamber located downstream of the admission tube and admission boreholes leading from the admission chamber into a centrifugal chamber of the centrifugal drum;

a rib body located in the admission chamber; and the rib body including a plurality of ribs and a base section connecting the plurality of ribs along a periphery of the base section, wherein the admission chamber includes a plurality of outlets from the admission chamber to the admission boreholes, wherein each of the plurality of outlets from the admission chamber is assigned to one of the plurality of ribs of the rib body, wherein each of the plurality of ribs is located in the admission chamber and outside of the boreholes and the outlets from the admission chamber, wherein the base section is connected in a torque-proof manner to the distributor or to a part affixed to the distributor, wherein the base section forms a circumferentially closed ring wherein the closed ring is conical or flat, wherein the admission tube includes a disk section vertically above a lower end of the admission tube or at a distal end of the admission tube, wherein a height of the plurality of ribs is greater than a vertical height of the plurality of outlets from the admission chamber to the admission boreholes.

2. The separator according to claim 1, wherein the admission chamber of the distributor is delimited vertically by the disk section on the admission tube.

3. The separator according to claim 2, wherein the disk section on the admission tube extends radially into an annular chamber which extends vertically above and vertically below the disk section and radially inwards beyond an external circumference of the disk section.

4. The separator according to claim 2, wherein the disk section extends radially and ends before contacting an internal circumference of the distributor.

5. The separator according to claim 1, wherein the disk section on the admission tube is vertically above the lower end of the admission tube and arranged in an annular chamber of the distributor, and wherein other ribs are disposed in the annular chamber, which other ribs entrain material to be centrifuged in the annular chamber in a peripheral direction.

6. The separator according to claim 1, wherein the ribs are aligned radially in relation to a rotational axis.

7. The separator according to claim 1, wherein the ribs are adjusted angularly at an angle between 1° and 80° to a radial of the rotational axis.

* * * * *